US005751801A

United States Patent [19]

Murata et al.

[11] Patent Number: 5,751,801

[45] Date of Patent: May 12, 1998

[54] CHARGING MEMBER WITH SURFACE LAYER COMPRISING POLYMERS, AND IMAGE FORMING APPARATUS USING THE SAME

[75] Inventors: Jun Murata, Kawagoe; Naoki Shirai, Koshigaya; Yoshiaki Nishimura, Tokyo; Yuzi Ishihara; Kiyoshi Mizoe, both of Kawasaki; Tsunenori Ashibe, Yokohama, all of Japan

[73] Assignee: Canon Kabushiki Kaisha, Tokyo, Japan

[21] Appl. No.: 895,547

[22] Filed: Jul. 16, 1997

Related U.S. Application Data

[63] Continuation of Ser. No. 451,765, May 26, 1995, abandoned.

[30] Foreign Application Priority Data

May 30, 1994 [JP] Japan ..... 6-116722

[51] Int. Cl.[6] ..... G03G 15/02

[52] U.S. Cl. ..... 399/176; 361/221

[58] Field of Search ..... 399/174, 175, 399/176; 361/221, 225; 430/902; 492/56

[56] References Cited

U.S. PATENT DOCUMENTS

| | | | |
|---|---|---|---|
| 3,959,573 | 5/1976 | Eddy et al. | 492/56 |
| 4,857,573 | 8/1989 | Simon | 524/291 |
| 5,440,374 | 8/1995 | Kisu | 355/219 |
| 5,471,285 | 11/1995 | Nagase et al. | 355/219 |

FOREIGN PATENT DOCUMENTS

| | | | |
|---|---|---|---|
| 0404079 | 12/1990 | European Pat. Off. . | |
| 0406834 | 1/1991 | European Pat. Off. . | |
| 0510643 | 10/1992 | European Pat. Off. . | |
| 0578071 | 1/1994 | European Pat. Off. . | |
| 6-49103 | 2/1994 | Japan | 355/219 |

*Primary Examiner*—Joan H. Pendegrass
*Attorney, Agent, or Firm*—Fitzpatrick, Cella, Harper & Scinto

[57] ABSTRACT

A charging member suitable for charging, e.g., a photosensitive member for electrophotography, is provided with improve surface-properties. The charging member is surface with a resin formed by plasticizing a rigid polymer with a plasticizing polymer chemically bonded to the rigid polymer.

24 Claims, 4 Drawing Sheets

CHARGING MEMBER WITH SURFACE LAYER COMPRISING POLYMERS, AND IMAGE FORMING APPARATUS USING THE SAME

This application is a continuation of application Ser. No. 08/451,765, filed May 26, 1995, now abandoned.

FIELD OF THE INVENTION AND RELATED ART

The present invention relates to a charging member for charging a charge-receiving member (a member to be charged) in contact with or in proximity to the charge-receiving member, and apparatus, particularly image forming apparatus, using the charging member.

In an image forming apparatus including an electrophotographic apparatus (such as a copying machine or a laser beam printer) and an electrostatic recording apparatus, a corona discharger has widely been used heretofore, as means for charging the surface of an image-carrying member as a charge-receiving member including a photosensitive member, a dielectric material, etc. Such a corona discharger is an effective means for uniformly charging the surface of a charge-receiving member, such as an image-carrying member to a desired potential level.

However, the corona charger requires a high-voltage power supply and utilizes corona discharge, thus being accompanied with a problem such as occurrence of ozone.

In contrast to such a corona discharger, a contact or proximity charging device as mentioned above is advantageous because it allows a lower applied voltage provided by a power supply, and generates less ozone.

Such a contact or proximity charging member may be formed by coating an electroconductive support with a resistance layer, or at least two layers including an upper resistance layer having an appropriate surface resistivity and a lower resistance layer having an appropriate elasticity for providing a proper nip width with the charge-receiving surface so as to effect uniform charging of the charge-receiving member, such as a photosensitive member, and prevention of charge leakage due to damages, such as pinholes and scars on the surface of the charge-receiving member.

In the case of a multi-layer structure including at least two resistance layers, the lower layer may comprise a resistance layer formed by dispersing carbon black, metal powder or another electroconductive powder of metal oxide, etc., in an elastic or elastomeric material, examples of which may include: synthetic rubbers, such as ethylene-propylene rubber (EPDM), styrene-butadiene rubber (SBR), chloroprene rubber (CR), nitrile-butadiene rubber (NBR), epichlorohydrin rubber and silicone rubber; natural rubber (NR); and thermoplastic elastomers, such as styrene-butadiene-styrene (SBS), polyolefins, and polyurethanes. The upper layer may comprise a resistance layer formed by dispersing electroconductive particles of carbon black or metal oxide in polymers, such as polyamide and urethane resin.

However, in the case of incorporating, e.g., electroconductive carbon black in the upper resistance layer (surface layer) in order to control the electroconductivity, the resistance film layer is caused to have a substantially increased hardness because the carbon black shows a large reinforcing effect to the matrix polymer. Further, in the case of using a carbon black or metal oxide showing a smaller reinforcing effect, the electroconductivity-imparting effect due to dispersion thereof is weak, so that a larger quantity thereof has to be dispersed, thereby also providing a film and therefore a charging member having an increased hardness.

In case where such a charging member is used in an electrophotographic apparatus, the photosensitive member is liable to be severely damaged to cause scars and wearing, thereby shortening the life of the photosensitive member and other difficulties such as filming of the toner on the photosensitive member.

Particularly, in case where a spongy layer is disposed as a lower layer, the surface layer is liable to be cracked under a pressure, and the noise due to vibration during the charging is liable to be enhanced in case where an AC power supply is used.

The above difficulties may be alleviated by adding a plasticizer, oil, surfactant, non-crystalline low-molecular weight oligomer, etc. to lower the hardness. In this case, however, such a low-molecular weight substance can migrate to the surface of the charging member to soil the photosensitive member or cause the toner sticking.

The use of an ionically electroconductive polymer may also be considered, but the use thereof is accompanied with difficulties, such as a large temperature-dependence of electrical resistivity, resistance change under voltage application and deterioration with time, so that the use of such an ionically conductive polymer is difficult at present.

SUMMARY OF THE INVENTION

An object of the present invention is to provide a charging member having a surface layer rich in deformation-followability.

Another object of the present invention is to provide a charging member not liable to soil a photosensitive member.

A further object of the present invention is to provide an image forming apparatus including such a charging member.

According to the present invention, there is provided a charging member having a surface layer comprising a resin comprising a rigid polymer, and a plasticizing polymer for plasticizing the rigid polymer bonded to the rigid polymer.

In the present invention, the rigid polymer forming the surface layer of the charging member is softened by bonding a plasticizing polymer thereto owing to intra-molecular plasticizing effect of the plasticizing polymer of suppressing the cohesion and crystallization of the rigid polymer. Accordingly, the rigid polymer can be softened without adding a softener, such as a low-molecular weight plasticizer or oil.

The plasticizing polymer is bonded to the rigid polymer, so that it is possible to prevent the migration of the plasticizing polymer resulting in problems, such as soiling of the photosensitive member or toner sticking. Further, as the rigidity of the surface layer is lowered, it is possible to provide a resistance layer excellent in deformation-followability.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
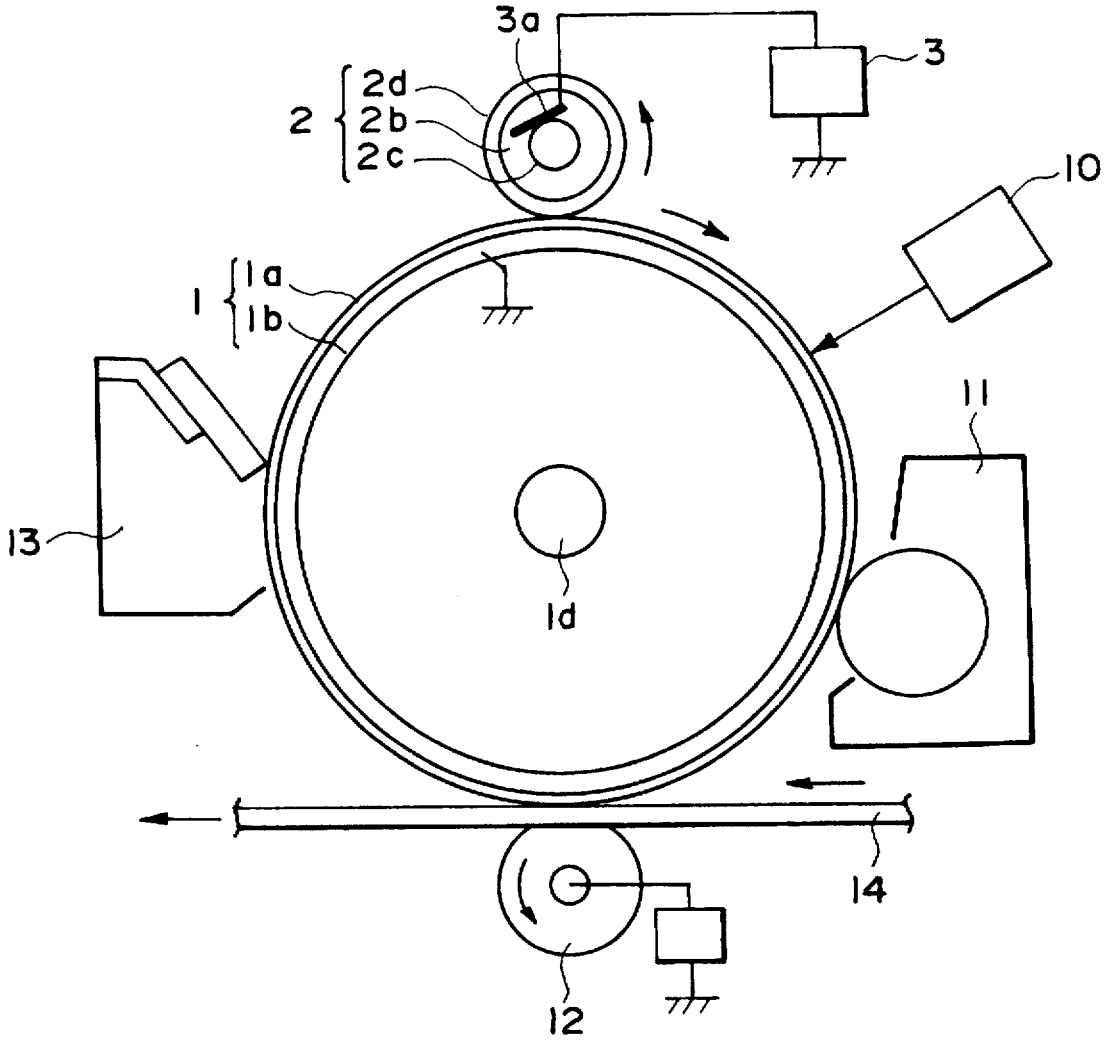
FIG. 1 is a schematic illustration of a transfer-type electrophotographic apparatus including a charging member according to the invention.

The plasticizing polymer may be chemically bonded to the rigid polymer in various manners, e.g., as a branch to the rigid polymer chain with a terminal end or a portion of the plasticizing polymer chain; at plural points of the plasticizing polymer chain to the rigid polymer chain so as to form a network or ladder; to a terminal end of the rigid polymer chain; and so as to form a block copolymer of the plasticizing polymer segment(s) and the rigid polymer segment (s).

Examples of the rigid polymer may include: various resins and elastomers, polyester, polyurethane, silicone resin, polyolefins, and styrene-based resins.

Such a rigid polymer may be typically characterized by a high tensile strength of larger than 200 kg·f/cm , particularly larger than 250 kg·f/cm , which per se may be desirable but is liable to lead to undesirable properties, such as excessive hardness and brittleness. If such a high tensile strength is obtained, the rigid polymer may also include polyamide and acrylic polymers.

The plasticizing polymer may be bonded to the rigid polymer to provide a surface layer resin, e.g., in the following manner.

(1) A functional group, such as —COOH, —$SO_2H$ or —NH—, is introduced into a rigid polymer by reacting a modifier compound, such as dimethylolpropionic acid, 1,2-dimethylolethylsulfonic acid or diethylolamine with a monomer or prepolymer providing the rigid polymer when the rigid polymer is synthesized. Then, a plasticizing polymer is caused to react with the functional group of the rigid polymer.

(2) A functional group, such as —COOH, —$SO_2H$ or —NH—, is introduced into a prepolymer of a rigid polymer by reaction with a modifier compound such as dimethylolpropionic acid, 1,2-dimethylolethylsulfonic acid or diethylolamine. Then, a plasticizing polymer is reacted with the functional group of the prepolymer followed by reaction of a crosslinking agent or a polyfunctional polymer to form a rigid polymer. Particularly, in the case where the rigid polymer is polyurethane, a plasticizing polymer may be reacted with a terminal-NCO group of a polyurethane prepolymer, followed by reaction with a crosslinking agent or a polyfunctional polymer. Alternatively, a polyurethane prepolymer may be reacted with a chain-elongating agent of an amine, such as tetramethylethylene diamine, tetramethyl-1,3-butanediamine, pentamethyldiethylenetetramine, or tetramethyl-1,3-diamino-1,2-propanol, to introduce a —$NH_2$ group at a terminal of the prepolymer, followed by reaction of a plasticizing polymer with the —$NH_2$ group and reaction with a crosslinking agent or a polyfunctional polymer to complete the rigid polymer unit.

In order to provide the plasticizing polymer with a reactivity with the rigid polymer or prepolymer thereof, a functional group may be introduced into the plasticizing polymer. This may be performed in the step of synthesizing the plasticizing polymer by reacting a monomer or prepolymer providing the plasticizing polymer, e.g., (1) with glycidyl methacrylate to introduce an epoxy group, (2) with polyethylene glycol, 2-hydroxyethyl methacrylate, N-methylolacrylamide, etc., to introduce an OH group, or (3) after converting the —OH group of (2) into an alkoxy group, with acrylamide, polyamide such as nylon, or tetramethylethylenediamine, to introduce a —$NH_2$ group.

More specifically, the reaction between the rigid polymer and the plasticizing polymer may be performed for example in the following manner.

(i) A prepolymer (of a rigid polymer) having —COOH group, e.g., through reaction between dimethylolpropionic acid and polyol is reacted with an acrylic resin (plasticizing polymer) having a terminal epoxy group.

(ii) A prepolymer (of a rigid polymer) having —COOH group is reacted with methylmethoxylated polyamide (plasticizing polymer).

(iii) A prepolymer (of a rigid polymer) having a terminal —NCO group with an acrylic resin (plasticizing polymer) having a terminal acrylamide.

The rigid polymer may suitably be plasticized with the plasticizing polymer to provide a surface layer resin having a tensile strength of at most 250 kg·f/cm , preferably at most 200 kg·f/$cm^2$. For this purpose, the plasticizing polymer may preferably have a function of providing, when bonded to the rigid polymer, a tensile strength which is lower by at least 50 kg·f/$cm^2$, particularly at least 100 kg·f/$cm^2$, than the rigid polymer alone.

The rigid polymer may preferably be a polyurethane-based polymer (a polymer principally comprising polyurethane) in view of flexibility, high-filler containing ability, mechanical strength, wear-resistance, etc.

The polyurethane may be produced by reaction between a polyol and a polyisocyanate.

Examples of the polyol may include: polyester polyols, including those of polyadipate-based, caprolactone-based, polycarbonate-based, acrylic polyols, polybutadiene-based, modified products of these and copolymer type; polyether polyols, such as polytetramethylene glycol, polyethylene glycol, polypropylene glycol, epoxy-modified products of these, and copolymer-type; and polyester polyols obtained by copolymerization of the above polyester polyols and polyether polyols.

Examples of the polyisocyanate may include: aromatic and aliphatic polyisocyanates, preferably diisocyanates, such as tolylene diisocyanate (TDI), methylene diphenylene diisocyanate (MDI), 1,6-hexamethylene, diisocyanate (HDI), 2,2,4 (or 2,4,4)-trimethylhexamethylene diisocyanate (TMDI), p-phenylene diisocyanate (PPDI), 4,4'-dicyclohexyl-methane diisocyanate (HMDI), dianisidine diisocyanate (DADI), isophorone diisocyanate (IPDI) and trans-1,4-cyclohexyl diisocyanate (CHDI).

The resistance layer may be formed by coating with an aqueous paint, e.g., by using various surfactants or by introduction of a hydrophilic group to the polymer, e.g., by copolymerization with a monomer having an anionic, cationic or nonionic hydrophilic group. In view of adverse effects arising from additives, such as migration to the photosensitive member, as descried above, however, the introduction of a hydrophilic group to the surface layer-forming resin may suitably be applied. This is effective not only for production of the surface layer-forming resin from the polyurethane-based rigid polymer. Such a monomer having a hydrophilic group may be bonded to the rigid polymer, the plasticizing polymer or both of these in an amount of, e.g., 2–10 wt. parts per 100 wt. parts of the resultant surface layer-forming resin.

Examples of the monomer having a hydrophilic group may include: anionic monomers inclusive of carboxylic acids, such as dimethylolpropionic acid, lysine and β-(2-aminoethyl)aminoethyl carboxylic acid, and salts thereof; sulfonic acids, such as β-(2-aminoethyl)aminoethylsulfonic acid and 1,2-dimethylol-ethylsulfonic acid, and salts thereof; and phosphoric acid and salts thereof; cationic monomers, inclusive of hydroxylamines, such as N-methyldimethylolamine; glycols, such as triethylene glycol; and nonionic monomers, such as $OCN(CH_2)_6$—$N(COO(CH_2O)_2CH_3)$—$CONH(CH_2)_6$—NCO.

The plasticizing polymer may suitably comprise a linear polymer, examples of which may include: polyamides, polyesters such as saturated aliphatic acid esters, acrylic polymers, polyolefins polysiloxanes, styrene-butadiene copolymer, and styrene-acrylonitrile copolymer. The plasticizing polymer can further include polyurethane if it effectively lowers the tensile strength of the rigid polymer when bonded to a rigid polymer.

The plasticizing polymer may suitably have a molecular weight (number-average) molecular weight (Mn) (as measured by gel permeation chromatography through calibration with standard polystyrene samples) in the range of 5,000–50,000.

The plasticizing polymer may preferably be bonded to the rigid polymer in a weight ratio of 1:2 to 10:1. If the plasticizing polymer is below the lower limit, the softening effect attained by the plasticizing polymer may be insufficient. On the other hand, above the upper limit, the property of the rigid polymer is reduced to result in a lower mechanical strength.

The plasticizing polymer may particularly preferably comprise an acrylic polymer in view of latitude of molecular designing, and excellent water resistance and weather resistance.

The combination of a polyurethane-based rigid polymer and an acrylic polymer-based plasticizing polymer provides synergistically excellent results inclusive of excellent high-filler containing effect and wear resistance attributable to the polyurethane, and excellent weather resistance and moisture resistance attributable to the acrylic polymer.

Examples of the acrylic polymer may include: homopolymers or copolymers of acrylates, such as methyl acrylate, ethyl acrylate, butyl methacrylate and ethyl methacrylate; hydroxyalkyl acrylates, such as hydroxyethyl methacrylate and hydroxypropyl acrylates; acryl amides, such as N-methylolacrylamides; other acrylic monomers, such as acrylonitrile, acrylic acid, and glycidyl methacrylate; and copolymers of these acrylic monomers with other monomers inclusive of styrene and styrene derivatives, such as vinyltoluene.

The acrylic polymer may be provided with an increased hydrophobicity by various methods but preferably be copolymerization with a monomer having a hydrophilic group for a similar reason described above with reference to the polyurethane.

In case where the surface layer-forming resin is formed by reaction between an acrylic polyester polyol (polyester polyol already including a plasticizing polymer segment) and a polyisocyanate, the surface layer-forming resin is provided with a block copolymer structure including an acrylic segment (plasticizing polymer segment) and a urethane segment (rigid polymer segment), causing a microphase separation effective for intra-molecular plasticization.

In case of using a polymer having a hydrophilic group incorporated thereinto, if an adverse effect thereof such as a resistance change due to moisture absorption is questioned after the formation of the resistance layer, it is possible to use a crosslinking agent reactive with a hydrophilic group, such as a carboxylic group. The crosslinking agent may be any of epoxy-type, amine-type, metal chelate-type, melamine-type, phenol-type, isocyanate-type, aldehyde-type, etc., but it is particularly suitable to use a melamine compound, such as methoxy-methylated melamine, which provides an excellent withstand voltage characteristic and shows little reactivity at room temperature.

The lower resistance layer may be formed from an elastic material, examples of which may include: rubbers, such as EPDM (ethylene-propylene-diene terpolymer), polybutadiene, natural rubber, polyisoprene, SBR (styrenebutadiene rubber), CR (chloroprene rubber), NBR (nitrile-butadiene rubber), silicone rubber, urethane rubber, and epichlorohydrin rubber; thermoplastic elastomers, such as RB (butadiene resin), those of polystyrene type such as SBS (styrene-butadiene-styrene elastomer), polyolefin type, polyester type, polyurethane type and PVD; and other polymer materials, such as polyurethane, polystyrene, PE (polyethylene), PP (polypropylene), PVD (polyvinyl chloride), acrylic resin, styrene-vinyl acetate copolymer, and butadiene-acrylonitrile copolymer.

The lower resistance layer may preferably have a hardness (ASKER-C) of 10–50 degrees.

Among the above-mentioned elastic materials, EPDM is particularly preferred because of relative inexpensiveness and little soiling characteristic.

The elastic material may be solid or in the form of a foam. However, a foam may be preferred in order to provide a sufficient nip width with the charge-receiving member so as to effect uniform charging and exhibit a silencing effect against the charging noise.

Examples of the electroconductive particles incorporated in the upper and lower resistance layers, as desired, may include: carbon black, metal powder and powders of metal oxide, such as titanium oxide, tin oxide and zinc oxide; and particles of an appropriate material coated with an electroconductive material, such as tin oxide, antimony oxide, indium oxide, molybdenum oxide, zinc, aluminum, gold, silver, copper, chromium, cobalt iron, lead, platinum or rhodium by electrolytic or electroless plating, spray coating or mixing roller vibration. The electroconductive particles may preferably be contained in 5–100 wt. parts per 100 wt. parts of the surface layer-forming resin.

The upper resistance layer (surface layer) may preferably be set to have a resistivity of $10^4$–$10^{12}$ ohm·cm and a thickness of 5–500 μm.

FIG. 1 is a schematic cross-sectional view of an embodiment of an electrophotographic apparatus including the charging member according to the present invention.

Referring to FIG. 1, a drum-type electrophotographic photosensitive member 1 is used as a charge-receiving member or charge-carrying member and comprises an electroconductive support layer **1*b* of, e.g., aluminum, and a photoconductive layer 1*a* formed on the support layer 1*b*. The photosensitive member 1 is rotated about an axis 1*d* at a prescribed peripheral speed in the clockwise direction. The photosensitive member 1 is uniformly charged by means of a charging member (i.e., charging roller in this embodiment) 2 for performing primary charging (by contact or proximity charging) to have prescribed polarity and potential at the surface thereof. The charging roller 2 comprises a core metal (or a shaft) 2*c* as an electroconductive support, an elastic layer 2*b* and a surface layer 2*d* disposed in this order. The core metal 2*c* has both end sections at which the core metal is rotatably supported by a bearing member (not shown). The core metal 2*c* is disposed parallel to the axis id, and the charging roller 2** is caused to abut upon the photosensitive member 1 under a prescribed pressure exerted by a pressing member (not shown), such as a spring, thus rotating mating with the rotation of the photosensitive member 1.

The primary charging (by contact or proximity charging) is performed by applying a DC bias voltage or a superposition of a DC bias voltage and an AC bias voltage to the core metal 2c through a friction (or rubbing) electrode 3a by means of a power supply 3, thus providing the peripheral surface of the rotating photosensitive member 1 with a prescribed polarity and a prescribed potential.

The peripheral surface of the photosensitive member 1 uniformly charged by the charging member 2 as described above is then subjected to imagewise exposure (e.g., laser beam scanning exposure or slit exposure of an original image) by image exposure means 10, whereby an electrostatic latent image corresponding to original image data is formed on the peripheral surface of the photosensitive member 1. The thus formed latent image is developed or visualized by developing means 11 with a toner to form a toner image (or developed image) in sequence.

The toner image is successively transferred to the front side of a transfer-receiving material 14 such as paper, being timely conveyed from a supply part (not shown) to a transfer position between the photosensitive member 1 and transfer means 12 (i.e., transfer roller in this embodiment) in synchronism with the rotation of the photosensitive member 1, by the transfer means 12. The transfer means (roller) 12 is used for charging the back side of the transfer-receiving material 14 so as to have a polarity opposite to that of the toner, whereby the toner image formed on the photosensitive member 1 is transferred to the front side of the material 14.

Then, the transfer-receiving material 14 having thereon the toner image is detached from the surface of the photosensitive member 1 and is conveyed to fixing means (not shown), thus being subjected to image fixing to be outputted as an image-formed product. Alternatively, the transfer-receiving material 14 is carried to reconveying means for conveying the material 14 back to the transfer position in the case of image formation also on the back side of the material 14.

The surface of the photosensitive member 1 after the transfer operation is subjected to cleaning by cleaning means 13 for removing and recovering an attached matter, such as a residual toner, from the surface of the photosensitive member 1, thus obtaining a cleaned surface to prepare for the next cycle.

The charging member 2 may also be in the form of a blade, a block, a rod or a belt in addition to the above-mentioned roller-type charging member as shown in FIG. 1. In the present invention, a charging member in the form of a roller or a blade may preferably be used.

In the case of the charging member 2 of the roller-type, the charging member 2 may be rotated mating with movement of a charge-receiving member in the form of, e.g., a sheet or may be one being not rotatable. The charging member 2 may also be rotated for itself at a prescribed peripheral speed in the direction identical to or opposite to the moving direction of the charge-receiving member (e.g., sheet-type) or the rotating direction of the above-mentioned drum-type photosensitive member.

In the present invention, a plurality of elements or components of an electrophotographic apparatus such as the above-mentioned photosensitive member, charging member, developing means and cleaning means may be integrally assembled into a process cartridge, so that the cartridge may be detachably mountable to the apparatus main body. For example, at least one component selected from a charging member, developing means and cleaning means may be integrally assembled together with a photosensitive member into a process cartridge, and such a cartridge may be attached to or detached from the apparatus body by the medium of a guiding means such as rail of the apparatus body. In a preferred embodiment, a charging member and/or developing means may be used together with a photosensitive member to constitute a process cartridge.

In case where the electrophotographic apparatus is used as a copying machine or printer, image exposure may be effected by using reflection light or transmitted light from an original or by reading data on the original, converting the data into a signal and then effecting a laser beam scanning, a drive of LED array or a drive of a liquid crystal shutter array in accordance with the signal.

Figure 2:
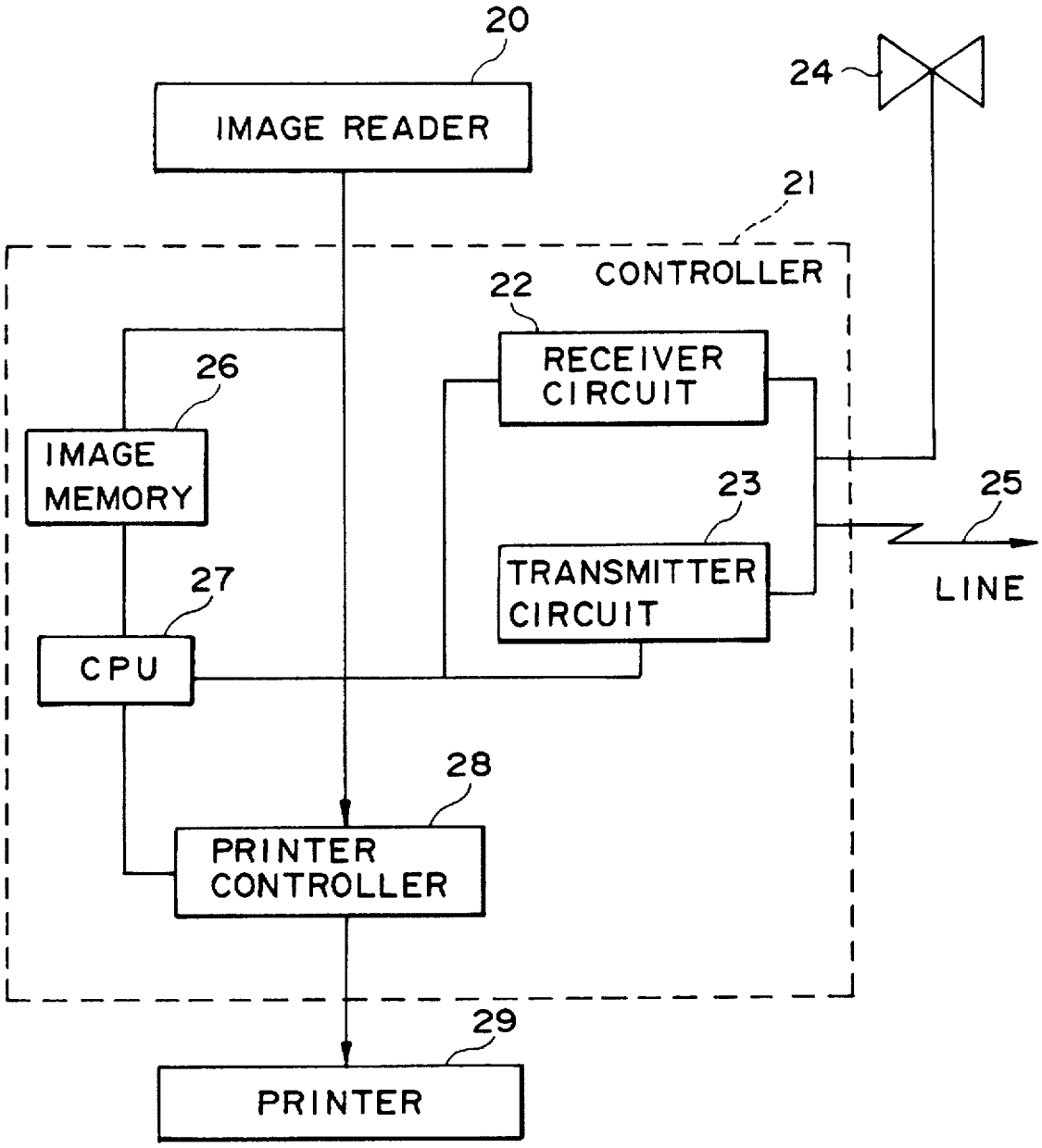
FIG. 2 is a block diagram of a facsimile apparatus including as a printer an electrophotographic apparatus including a charging member according to the invention.

In case where the electrophotographic apparatus including the charging member according to the present invention is used as a printer for facsimile, the above-mentioned image exposure means corresponds to that for printing received data. FIG. 2 shows such an embodiment by using a block diagram.

Referring to FIG. 2, a controller 21 controls an image reader (or image reading unit) 20 and a printer 29. The entirety of the controller 21 is regulated by a CPU (central processing unit) 27. Read data from the image reader 20 is transmitted through a transmitter circuit 23 to another terminal such as facsimile. On the other hand, data received from another terminal such as facsimile is transmitted through a receiver circuit 22 to the printer 29. An image memory 26 stores prescribed image data. A printer controller 28 controls the printer 29. In FIG. 2, reference numeral 24 denotes a telephone set.

More specifically, an image received from a line (or circuit) 25 (i.e., image information received from a remote terminal connected by the line) is demodulated by means of the receiver circuit 22, decoded by the CPU 27, and sequentially stored in the image memory 26. When image data corresponding to at least one page is stored in the image memory 26, image recording is effected with respect to the corresponding page. The CPU 27 reads image data corresponding to one page from the image memory 26, and transmits the decoded data corresponding to one page to the printer controller 28. When the printer controller 28 receives the image data corresponding to one page from the CPU 27, the printer controller 28 controls the printer 29 so that image data recording corresponding to the page is effected. During the recording by the printer 29, the CPU 27 receives another image data corresponding to the next page.

Thus, receiving and recording of an image may be effected by means of the apparatus shown in FIG. 2 in the above-mentioned manner.

More specifically, an electrophotographic member 1 as shown in FIG. 1 may be constituted in the following manner.

A photosensitive layer la may be formed on an electroconductive support lb. The electroconductive support may be composed of a material which per se has an electroconductivity, e.g., a metal, such as aluminum, aluminum alloy, stainless steel or nickel., or may comprise a plastic material coated, e.g., with a vapor-deposited film of aluminum, aluminum alloy or indium oxide-tin oxide, a coating layer of electroconductive particles (such as carbon black or tin oxide particles) together with an appropriate binder on a support of a metal or plastic, or a plastic comprising an electroconductive binder.

It is also possible to dispose an undercoating layer having a barrier function and an adhesive function between the electroconductive support and the photosensitive layer. Such an undercoating layer may be formed of, e.g., casein, polyvinyl alcohol, nitrocellulose, ethylene-acrylic acid copolymer, polyamide (such as nylon 6, nylon 66, nylon 610, or copolymer nylon), polyurethane, gelatin, or aluminum oxide in a thickness of at most 5 μm, preferably 0.5–3 μm. The undercoating layer may desirably have a resistivity of at least $10^7$ ohm·cm in order to exhibit its function.

The photosensitive layer 1 may be formed as a coating layer of an organic or inorganic photoconductor, optionally together with a binder, or by vapor-deposition.

The photosensitive layer may preferably assume a function separation-type laminated photosensitive layer structure including a charge generation layer and a charge transparent layer.

The charge generation layer may be formed as a coating layer of a charge generating substance, such as an azo pigment, phthalocyanine pigment, quinoline pigment or perylene pigment formed by vapor deposition or together with an appropriate binder resin, as desired, in a thickness of 0.01–5 μm, preferably 0.05–2 μm.

The charge transport layer may be formed as a coating layer of a charge transporting substance, such as a hydrazone compound, styryl compound, oxazole compound or triarylamine compound together with an appropriate film-forming binder resin in a thickness of 5–50 μm, preferably 10–30 μm.

It is also possible to dispose a protective layer on the photosensitive layer so as to prevent deterioration, e.g., by ultraviolet radiation.

The present invention will be more specifically descried with reference to Examples.

EXAMPLE 1

Figure 3:
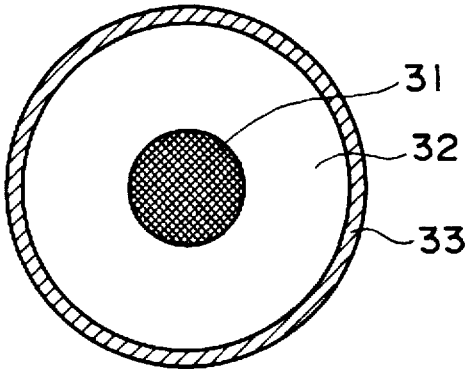
FIG. 3 is a cross-sectional illustration of a charging roller according to the invention.

A charging roller having a cross-section (taken perpendicularly to the roller axis) as shown in FIG. 3 was prepared.

Figure 4:
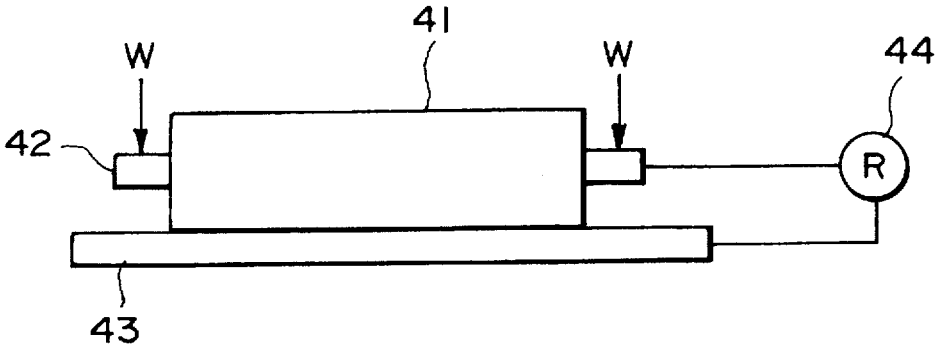
FIG. 4 is an illustration of a manner of measuring the resistance of a charging roller.

A 6 mm dia.-core metal 31 of stainless steel in a length of 250 mm was coated in a length of 230 mm with a sponge roller layer 32 of $10^5$ ohm, a medium resistance. Incidentally, in case where a defect, such as a pinhole, occurs on a photosensitive member, a low-resistance sponge layer 32 is liable to scorch due to an excessive current flow. In order to prevent such a difficulty and flow a necessary charging current, the sponge roller layer may preferably have a resistance in the range of $10^4$–$10^8$ ohm as measured in a manner illustrated in FIG. 4, wherein the resistance of a roller 41 may be measured between a core metal 42 and an aluminum plate 43 by a resistance meter 44 under application of two loads W each of, e.g., 500 g (for providing a nip width of ca. 2 mm) on both lateral ends of the core metal 42 and an applied voltage of 100 volts.

More specifically, the sponge roller 32 was composed from 100 wt. parts of EPDM, 5–15 wt. parts of ketjen black having a primary particle size of 30 mμ (an electroconductivity-imparting agent) and 5–10 wt. parts of azodicarbonamide (a foaming agent). The rubber mixture was shaped into a tube by extrusion and subjected to vulcanization inclusive of first vulcanization with water vapor for foaming at 160° C. for 30 min. and second vulcanization at 200° C. for 10 min. in an electric furnace.

The thus-formed foam tube had an uneven surface with uneven degree of foaming and hardness irregularity at the surface part, which was therefore removed by abrasion to form a sponge roller of 12 mm-diameter. The thus-formed sponge roller had a foam diameter of ca. 100 μm and an ASKER-C hardness of 35 degrees.

Then, the sponge roller 32 was coated with a resistance layer 33 so as to provide a uniform surface for preventing charging irregularity and preventing current leakage to pinholes on the photosensitive member, after coating with a silane coupling agent primer so as to ensure the adhesion between the sponge layer 32 surface and the resistance coating layer 33.

The resistance layer 33 was formed by applying an aqueous coating composition prepared as follows.

An acrylic copolymer (composed of 40 wt. parts of methyl methacrylate, 30 wt. parts of n-butyl acrylate, 20 wt. parts of styrene, 8 wt. parts of 2-hydroxyethyl methacrylate and 1 wt. part of methacrylic acid, Mn=ca. $2\times10^4$) (plasticizing polymer) having a terminal glycidyl methacrylate group, was reacted with an adipate-based polyester polyol (formed by reaction between 100 wt. parts of polyester polyol formed from adipic acid and neopentyl glycol and 6 wt. parts of dimethylolpropionic acid) to form an acrylic polymer-modified polyester polyol, which was then reacted with 45 wt. parts of isophorone diisocyanate. The resultant was dispersed in water under high-speed stirring and further reacted with 3 wt. parts of hexamethylenediamine for chain elongation to form an aqueous coating liquid containing an acrylic polymer-bonded polyurethane having an acrylic polymer (plasticizing polymer) segment: polyurethane segment ratio (by weight) of ca. 4:1.

The resultant aqueous acrylic polymer-modified polyurethane coating liquid (containing 40 wt. parts of solid matter and 100 wt. parts of water) was cast on a glass sheet and dried for 12 hours by air. Thereafter, the film was peeled off from the glass sheet and dried at 120° C. for 10 min. The thus-formed film in a thickness of 0.1 mm was cut into a strip of 10 mm in width and 100 mm in length. The film was subjected to a tensile test at a pulling speed of 100 mm/min. at 20° C. to measure a tensile strength ($M_{100}$) of 76 kg·f/cm$^2$.

Separately, into the aqueous acrylic polymer-modified polyurethane coating liquid, 30 wt. % (based on the resin in the coating liquid) of electroconductive particles of tin oxide doped with antimony for imparting electroconductivity ($SnO_2.Sb_2O_5$) having a particle size of 0.1–0.2 μm were dispersed by using a paint shaker for 12 hours to form a coating liquid having a viscosity of 200 cps.

Incidentally, electroconductive particles of a medium conductivity, i.e., a volume resistivity on the order of 10 ohm·cm like the above-mentioned antimony-doped tin oxide particles, are preferred to more conductive particles, such as carbon black having a lower volume resistivity on the order of 0.1–1 ohm·cm, so as to provide a resistance layer having a stably controlled volume resistivity less sensitive to a fluctuation in addition amount of the electroconductive particles. Further, in the above dispersion process, a good dispersion should be ensured since a poor dispersion is liable to result in locally insulated minute regions at the surface layer of the charging member, leading to a charging failure at the corresponding parts on the photosensitive member.

Further, 6 wt. parts of hexamethylmethoxymelamine (hydrophobicity-imparting agent) was added to the coating liquid containing 100 wt. parts of the resin so as to reset with hydrophilic carboxyl group.

Into the coating liquid thus prepared, the above-prepared sponge roller was dipped and pulled up at a rate of 30 mm/sec. The coating step was repeated twice in mutually reverse axial pulling-up directions so as to provide a uniform dry-coating thickness of ca. 80 μm. Incidentally, the roller coating method and the beam coating method may also be adopted for the coating.

Finally, the coated roller was dried for 30 min. in a hot air drying oven at 135° C. The thus-prepared charging roller had a uniform surface free from surface defects leading to images with a sandy appearance. The roller showed a resistance of $10^6$ ohm as measured in the above-described manner with reference to FIG. 4 and an ASKER-C hardness of 45 degrees.

The thus-prepared charging roller was incorporated as a charging roller 2 in an image forming apparatus as shown in FIG. 1 and used for charging and image formation under application of a superposed voltage including a DC voltage of −700 volts and an AC voltage of 500 Hz and 2000 volts (Vpp), whereby the photosensitive member 1 could be uniformly charged at −700 volts under all environmental conditions inclusive of high temperature-high humidity and low temperature-low humidity.

Further, the charging roller was used for 6000 A4-sheets of successive image formation. Even after the successive image formation, the charging roller was free from any surface change, such as surface crack, and showed an identical charging characteristic as the initial stage.

Separately, the coating liquid for the resistance layer (containing electroconductive particles) was applied on an aluminum sheet and dried at 135° C. for 30 min. in a hot air drying oven to form a 25 μm-thick film, onto which a 50 mm-dia. electrode was abutted under a load of 200 g and a voltage of 10 volts was applied. As a result, the film showed a resistivity of $10^8$ ohm·cm.

EXAMPLE 2

An aqueous acrylic polymer-modified polyurethane coating liquid was prepared similarly as in Example 1 except that the acrylic polymer: polyurethane ratio was changed to ca. 1:1. Separately, the same electroconductive particles of $SnO_2.Sb_2O_5$ as used in Example 1 were dispersed into water which has been adjusted to pH 5.5 by addition of ammonia water. Then, the modified polyurethane coating liquid and the conductive particle dispersion slurry was mixed with each other in a solid/solid weight ratio of 1/0.3. (A uniform dispersion may be effected by using a simple stirrer, but an appropriate dispersion apparatus may also be used, if desired.)

The resultant coating liquid had a viscosity of 200 cps.

A charging roller was prepared in the same manner as in Example 1 except for using the thus-prepared coating liquid for preparing a surface resistance layer. As a result of evaluation, the charging roller showed similar performances as in Example 1.

As a result of separate film formation by using the coating liquid similarly as in Example 1, the resultant film sample showed a tensile strength of 110 kg·f/cm$^2$.

COMPARATIVE EXAMPLE 1

An aqueous polyurethane coating composition was prepared similarly as in Example 1 except for omitting the modifying acrylic copolymer (plasticizing polymer), and the antimony-doped tin oxide particles were dispersed into the polyurethane coating composition similarly as in Example 1 to form a coating liquid for a surface resistance layer.

A sponge roller prepared in the same manner was dip-coated twice with the above-coating liquid and dried similarly as in Example 1 to form a charging roller.

After the drying, the charging roller resulted in thin furrows extending in the longitudinal direction of the roller.

When the roller was rotated under pressing against the photosensitive member as in Example 1, the roller caused surface crocks which resulted in streaks in images as a result of image formation.

As a result of separate film formation by using the coating liquid similarly as in Example 1, the resultant film sample showed a tensile strength of 442 kg·f/cm$^2$.

EXAMPLE 3

An embodiment of using a charging member according to the present invention as a transfer roller will now be described.

A transfer roller in an electrophotographic apparatus is a member for electrostatic transfer of a toner image on an image-bearing member such as a photosensitive member, an intermediate transfer member or a transfer drum, onto transfer-receiving paper under application of a voltage thereto.

The transfer roller is required to show a medium level of resistance on the order of $10^5$–$10^9$ ohm so as to prevent a local concentration of transfer current, a low hardness for preventing a transfer failure liable to occur under a high transfer pressure, and a high releasability for easily removing an excessive toner attached thereto.

In order to suffice the above-required properties, particularly a low hardness, a sponge roller with a medium level of resistance may be generally used and may comprise EPDM, CR or polyurethane containing electroconductive powder, such as carbon or zinc oxide powder, and foamed.

However, such a sponge roller has an uneven surface and requires a high transfer voltage for a transfer paper which is liable to have an increased resistance particularly in a low temperature-low humidity environment. In this instance, an excessive transfer current is concentrated at projecting parts and flown to the photosensitive member, so that the resultant local charge cannot be removed after the transfer to result in spots in a subsequent image.

In contrast thereto, however, when the charging roller prepared in Example 2 having a smooth surface was used as a transfer roller, uniform transfer images could be formed even in a low temperature-low humidity environment.

Further, as a result of the surface smoothening, the attachment of toner powder, etc. was remarkably decreased to improve the durability of the transfer roller.

Further, it was possible to obviate difficulties accompanying an increase in surface rigidity, such as resolution failure of character images and surface layer cracking during a successive image formation.

EXAMPLE 4

An aqueous plasticizing polymer-modified polyurethane coating liquid was prepared similarly as in Example 1 except that a polyacetal copolymer (composed of 10 mol. % of polyvinyl butyral, 40 mol. % of polyvinyl acetate and 50 mol. % of polyvinyl alcohol, Mn=ca. $3\times10^4$) having a terminal acrylic glycidyl ether group was used as a plasticizing polymer instead of the acrylic copolymer to provide an aqueous polyacetal-modified polyurethane having a polyacetal: polyurethane ratio of ca. 1:1 (by weight). Into the coating liquid, antimony-doped tin oxide particles were dispersed similarly as in Example 1 to prepare a coating liquid for a resistance layer.

A charging roller was prepared in the same manner as in Example 1 except for using the thus-prepared coating liquid for preparing a surface resistance layer. As a result of evaluation, the charging roller showed similar performances as in Example 1.

As a result of separate film formation by using the coating liquid similarly as in Example 1, the resultant film sample showed a tensile strength of 150 kg·f/cm$^2$.

EXAMPLE 5

A plasticizing polyamide was prepared by methylmethoxylating 20% of amide hydrogen of 6,10-nylon (Mn= ca. 10,000) and reacted with a polyester polyol (formed by reaction between 100 wt. parts of polyester polyol formed from neopentyl glycol and adipic acid, and 5 wt. parts of 2,4-diaminohexane), followed further by reaction with HMDI (4,4'-dicyclohexylmethane diisocyanate), to prepare a polyamide-modified polyurethane having a polyamide: polyurethane ratio of ca. 1:2 (by weight). The polyamide-modified polyurethane was formulated into an aqueous coating liquid, into which antimony-doped tin oxide particles were dispersed similarly as in Example 1 to obtain an aqueous coating liquid for a resistance layer.

A charging roller was prepared in the same manner as in Example 1 except for using the thus-prepared coating liquid for preparing a surface resistance layer. As a result of evaluation, the charging roller showed similar performances as in Example 1. Further, even after 4000 sheets of successive image formation, the charging roller was free from any change in surface appearance such as crack and showed an identical charging performance as the initial stage.

As a result of separate film formation by using the coating liquid similarly as in Example 1, the resultant film sample showed a tensile strength of 160 kg·f/cm$^2$. Incidentally, a film formed similarly as above except for omitting the use of the plasticizing polyamide showed a tensile strength of 310 kg·f/cm$^2$.

What is claimed is:

1. A charging member, having a surface layer comprising a resin comprising a rigid polymer, and a plasticizing polymer for plasticizing the rigid polymer chemically bonded to the rigid polymer.

2. The charging member according to claim 1, wherein said plasticizing polymer is a linear polymer.

3. The charging member according to claim 1, wherein said resin comprises the plasticizing polymer and the rigid polymer in a weight ratio of 1:2 to 10:1.

4. The charging member according to claim 1, wherein said rigid polymer comprises a polyurethane-based polymer.

5. The charging member according to claim 1, wherein said plasticizing polymer comprises an acrylic polymer.

6. The charging member according to claim 1, wherein said rigid polymer comprises a polyurethane-based polymer and said plasticizing polymer comprises an acrylic polymer.

7. The charging member according to any of claims 1–6, wherein said surface layer is disposed via an electroconductive elastic layer on an electroconductive substrate.

8. The charging member according to claim 7, wherein said electroconductive elastic layer is porous.

9. The charging member according to any one of claims 1 through 6, wherein said surface layer has a tensile strength of at most 250 kg·f/cm$^2$, a resistivity of $10^4$ to $10^{12}$ ohm·cm and a thickness of 5–500 μm and is suitable for charging a photosensitive member in contact therewith.

10. An electrophotographic image forming method comprising the steps of:

causing a charging member to contact a photosensitive member thereby uniformly charging the photosensitive member, image-exposing the charged photosensitive member to form a latent image on the photosensitive member, developing the latent image with a toner to form a toner image on the photosensitive member, and transferring the toner image onto a transfer-receiving material, wherein said charging member is a charging member according to any one of claims 1 through 6.

11. The charging member according to any one of claims 1 through 6, wherein said charging member is used for contact-charging an electrophotographic photosensitive member.

12. A charging method comprising the steps of:

disposing a charging member according to any one of claims 1 through 6 in contact with an electrophotographic photosensitive member, and supplying a voltage to the charging member to charge the electrophotographic photosensitive member in contact with the charging member.

13. A process cartridge, detachably mountable to an image forming apparatus main body, comprising: a photosensitive member, a charging member, and at least one of a developing means and a cleaning means integrated into the cartridge; wherein said charging member comprises a resin comprising a rigid polymer, and a plasticizing polymer for plasticizing the rigid polymer chemically bonded to the rigid polymer.

14. The process cartridge according to claim 13, wherein said plasticizing polymer is a linear polymer.

15. The process cartridge according to claim 13, wherein said resin comprises the plasticizing polymer and the rigid polymer in a weight ratio of 1:2 to 10:1.

16. The process cartridge according to claim 13, wherein said rigid polymer comprises a polyurethane-based polymer.

17. The process cartridge according to claim 13, wherein said plasticizing polymer comprises an acrylic polymer.

18. The process cartridge according to any one of claims 13 through 17, wherein said charging member is in contact with the photosensitive member.

19. An electrophotographic apparatus, comprising a photosensitive member, a latent image forming means including a charging member, a developing means for developing a latent image, and a transfer means for transferring a developed image onto a transfer-receiving material; wherein said charging member comprises a resin comprising a rigid polymer, and a plasticizing polymer for plasticizing the rigid polymer chemically bonded to the rigid polymer.

20. The apparatus according to claim 19, wherein said plasticizing polymer is a linear polymer.

21. The apparatus according to claim 19, wherein said resin comprises the plasticizing polymer and the rigid polymer in a weight ratio of 1:2 to 10:1.

22. The apparatus according to claim 19, wherein said rigid polymer comprises a polyurethane-based polymer.

23. The apparatus according to claim 19, wherein said plasticizing polymer comprises an acrylic polymer.

24. The apparatus according to any one of claims 19 through 23, wherein said charging member is in contact with the photosensitive member.

* * * * *

UNITED STATES PATENT AND TRADEMARK OFFICE

CERTIFICATE OF CORRECTION

PATENT NO. : 5,751,801

DATED : May 12, 1998

INVENTORS : JUN MURATA, ET AL.

It is certified that error appears in the above-identified patent and that said Letters Patent is hereby corrected as shown below:

ON THE TITLE PAGE ,

Item [57] ABSTRACT,
Line 3, "improve surface-properties," should read --improved surface properties.--; and "is" should read --has a--; and
Line 4, "with" should read --layer containing--.

COLUMN 3,
Line 21, "200 kg·f/cm," should read --200 kg·f/cm$^2$,--; and
Line 22, "250 kg·f/cm," should read --250 kg·f/cm$^2$,--.

COLUMN 4,
Line 45, "1,6-hexamethylene," should read --1,6 -hexamethylene--.

COLUMN 6,
Line 6, "withstand voltage" should read --voltage withstanding--;
Line 39, "cobalt" should read --cobalt,--; and
Line 66, "id," should read --1*d*--.

COLUMN 7,
Line 34, "to" should read --to a--;
Line 45, "cleaned" should read --clean--; and
Line 55, "being" should be deleted.

UNITED STATES PATENT AND TRADEMARK OFFICE

CERTIFICATE OF CORRECTION

PATENT NO. : 5,751,801

DATED : May 12, 1998

INVENTORS : JUN MURATA, ET AL.

It is certified that error appears in the above-identified patent and that said Letters Patent is hereby corrected as shown below:

COLUMN 8,
Line 5, "as should read --as a--;
Line 27, "as" should read --as a--; and
Line 28, "as" should read --as a--.

COLUMN 9,
Line 29, "descried" should read --described--; and
Line 61, "uneven" should read --an uneven--.

COLUMN 11,
Line 60, "above-coating" should read --above coating--; and
Line 66, "crocks" should read --cracks--.

COLUMN 13,
Line 21, "crack" should read --cracking--.

Signed and Sealed this

Eighteenth Day of May, 1999

*Attest:*

Q. TODD DICKINSON

*Attesting Officer*

*Acting Commissioner of Patents and Trademarks*